US007708141B1

(12) United States Patent
Huang

(10) Patent No.: US 7,708,141 B1
(45) Date of Patent: May 4, 2010

(54) FILE HOLDER WITH HANGING MECHANISM

(76) Inventor: James C. Huang, No.45-4, Jingcheng 3rd St., West District, Taichung City (TW)

( * ) Notice: Subject to any disclaimer, the term of this patent is extended or adjusted under 35 U.S.C. 154(b) by 0 days.

(21) Appl. No.: 12/537,435

(22) Filed: Aug. 7, 2009

(51) Int. Cl.
*B65D 85/00* (2006.01)

(52) U.S. Cl. ..... 206/425; 206/479; 206/481; 383/14

(58) Field of Classification Search ..... 206/425, 206/478, 479, 481, 483, 806; 190/102, 115; 220/457, 762, 763, 770; 383/11, 14, 26, 383/28; 229/67.1, 67.2, 67.4
See application file for complete search history.

(56) References Cited

U.S. PATENT DOCUMENTS

| | | | | | |
|---|---|---|---|---|---|
| 577,668 | A * | 2/1897 | Stellner | ..... | 294/149 |
| 948,170 | A * | 2/1910 | Grossman | ..... | 190/102 |
| 1,164,833 | A * | 12/1915 | Macaulay | ..... | 150/107 |
| 1,991,306 | A * | 2/1935 | Woolsey | ..... | 132/312 |
| 2,781,113 | A * | 2/1957 | Seeman | ..... | 190/102 |
| 4,265,286 | A * | 5/1981 | Rapoport | ..... | 190/108 |
| 5,027,874 | A * | 7/1991 | Gazzola | ..... | 150/108 |
| 5,533,809 | A * | 7/1996 | Gorman | ..... | 383/11 |
| 5,950,893 | A * | 9/1999 | Heggeland | ..... | 224/578 |
| 6,678,974 | B1 * | 1/2004 | Su | ..... | 40/124.2 |
| 6,874,628 | B2 * | 4/2005 | Hammill | ..... | 206/317 |
| 6,968,949 | B2 * | 11/2005 | Zivic et al. | ..... | 206/425 |

* cited by examiner

*Primary Examiner*—David T Fidei
(74) *Attorney, Agent, or Firm*—Egbert Law Offices PLLC

(57) ABSTRACT

The present invention provides a file holder with a hanging mechanism, wherein the file holder includes a main body and a hanging mechanism. The hanging mechanism is arranged onto the inner wall of a front panel of the main body and includes a limiting portion, a hanging band and a locator. The first locating end of the locator can be meshed with or disengaged from the second locating end. The hanging band is penetrated into the limiting portion. The hanging band can be retractably concealed into the front panel, or pulled outwards in a hanging state. The hanging band can be limited by meshing of the first locating end with the second locating end or by abutting separately the first and second locating ends onto the first and second threading portions.

3 Claims, 5 Drawing Sheets

FILE HOLDER WITH HANGING MECHANISM

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a file holder, and more particularly to an innovative file holder with a hanging mechanism for improved functionality.

2. Description of Related Art

Including Information Disclosed Under 37 CFR 1.97 and 37 CFR 1.98.

There are a variety of file holders available in the stationery market, which are used by the people to accommodate files and papers in an orderly way.

In order to promote the functionality of the file holder, a hanging file holder has been developed, namely, a hanger strap is fixed on the front panel of the file holder for easy hanging and retracting with better functions.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

Based on the unique present invention, the file holder mainly comprises of a main body and hanging mechanism. The hanging mechanism includes a limiting portion, hanging band and locator, the hanging band can be pulled in a limiting state or positioned in a retraction state with the meshing or disengagement of the first and second locating ends of the locator, thereby improving the operational functionality and aesthetic applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
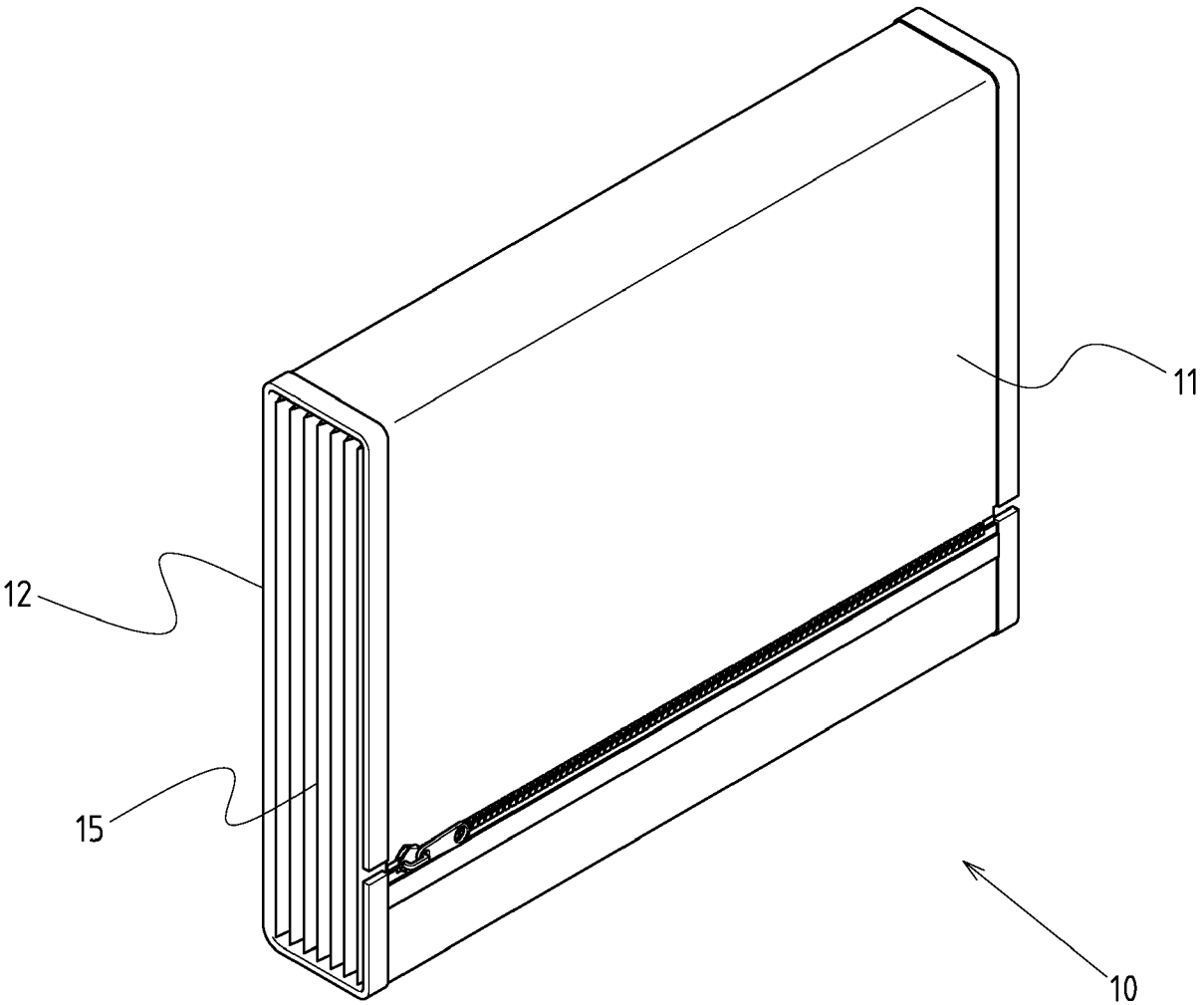
FIG. 1 shows an external perspective view of the main body of the present invention.
Figure 2:
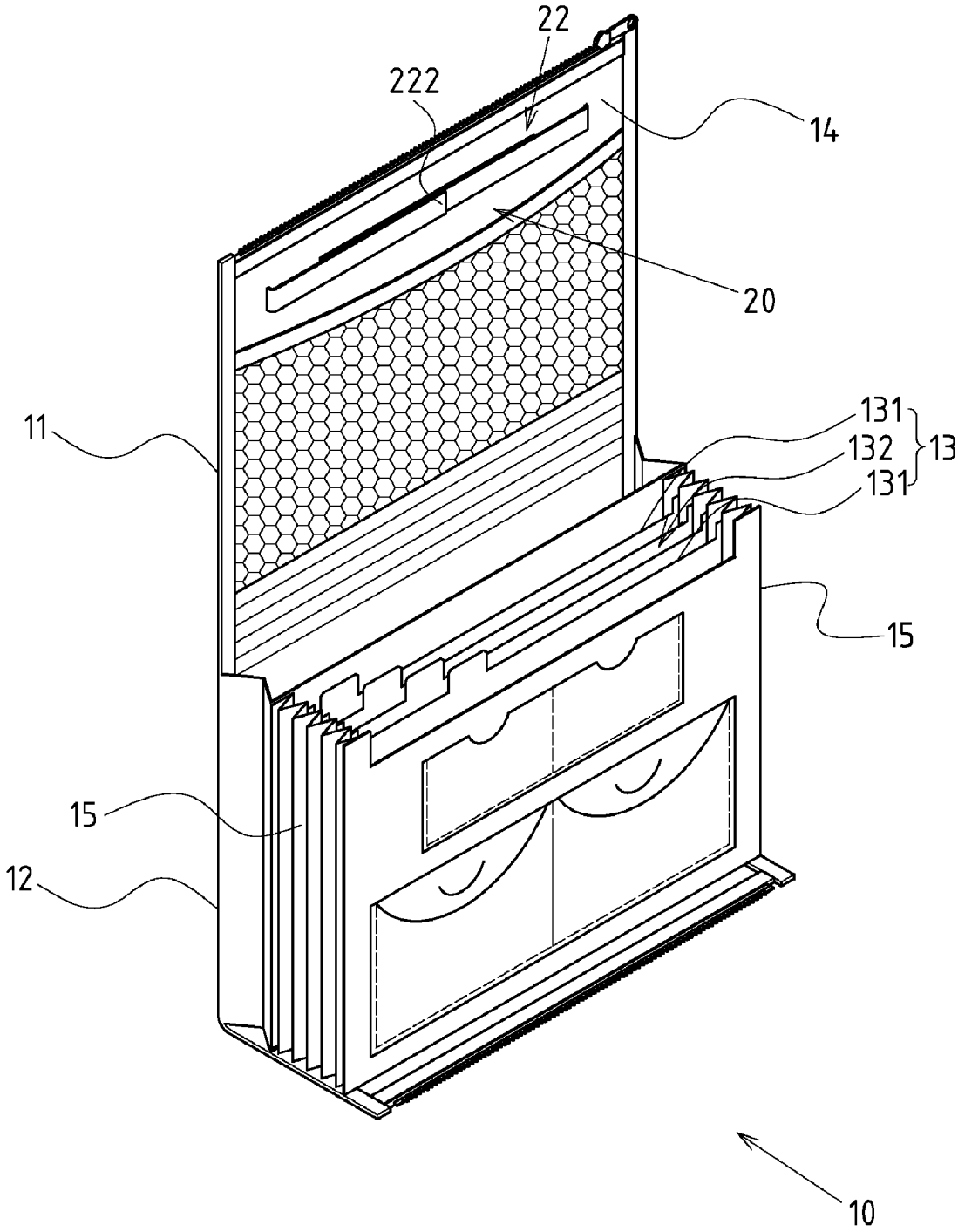
FIG. 2 shows a perspective view of the present invention, showing the hanging band positioned in a retraction state.
Figure 3:
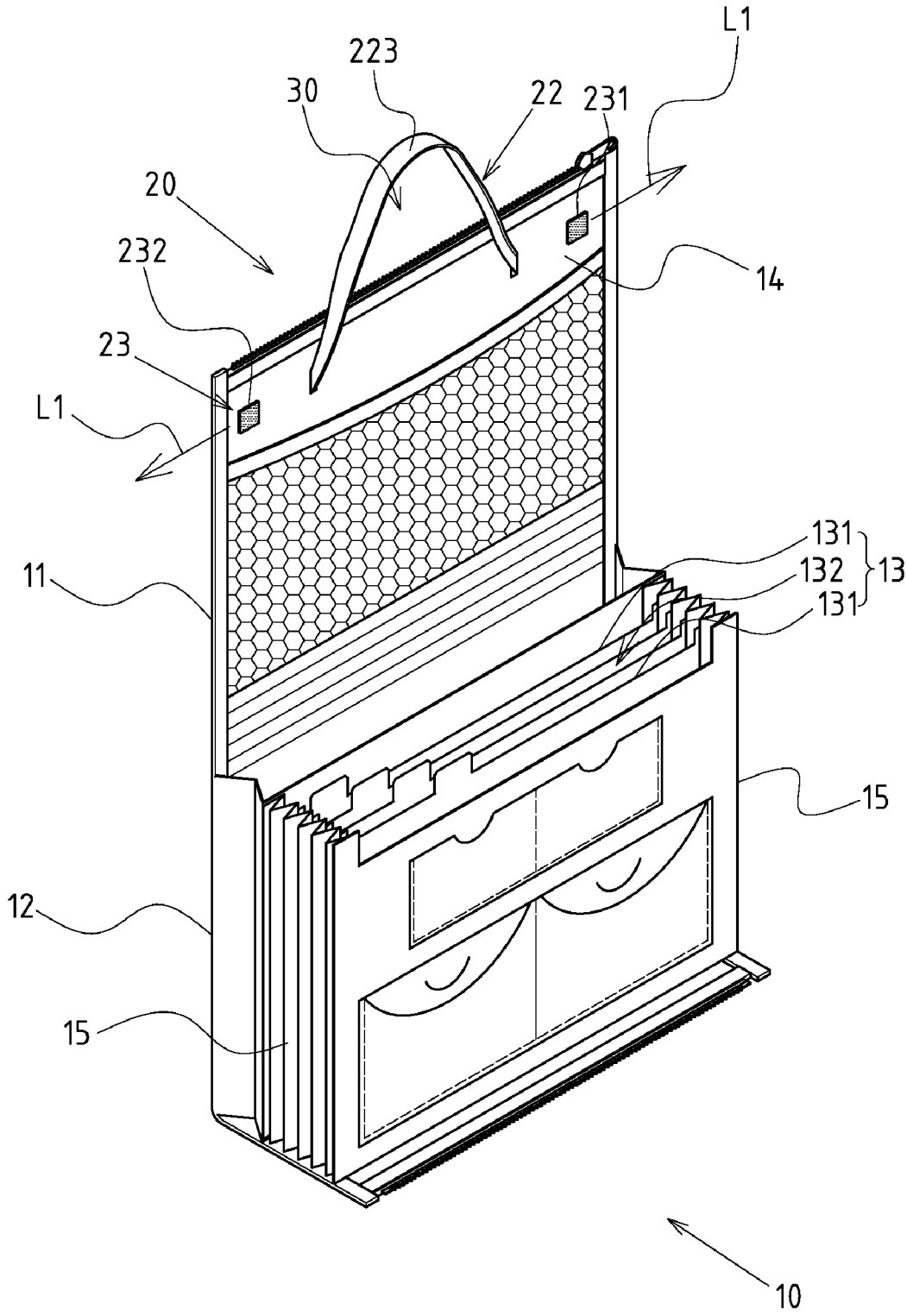
FIG. 3 shows a perspective view of the present invention, showing the hanging band pulled in a hanging state.

FIGS. 1-3 depict preferred embodiments of a file folder of the present invention with a hanging mechanism. The embodiments are provided for only explanatory purposes with respect to the patent claims.

The file holder comprises a main body 10, including a front panel 11, a rear panel 12 arranged at intervals, and an accommodation space 13 between the front and rear panels 11, 12. The accommodation space 13 allows a plurality of partitions 131 to divide itself into a plurality of accommodation spaces 132, and also form a side plate 15 with two V-shaped corrugated surfaces. Alternatively, the accommodation space 13 can be enclosed by pieces of cloth and cardboard (note: the schematic view not shown herein). The front panel 11 is provided with an inner wall 14. A hanging mechanism 20 is arranged onto the inner wall 14 of the front panel 11 of the main body 10. The hanging mechanism 20 is also arranged at the opening of the accommodation space 13. The hanging mechanism 20 includes a limiting portion 21, set on the inner wall 14 of the front panel 11. The limiting portion 21 includes a first threading portion 211 and a second threading portion 212 arranged at intervals. The first and second threading portions 211, 212 of the limiting portion 21 are of two through-holes arranged at intervals, so that a hanging band 22 can pass the through-hole for a limitation state. A hanging band 22 extends to form two ends 221, 222 and an intermediate section 223. The hanging band 22 is penetrated onto the first and second threading portions 211, 212 of the limiting portion 21.

A locator 23 is arranged at two ends 221, 222 of the hanging band 22 and fitted with a first locating end 231 and a second locating end 232. The first locating end 231 can be meshed with or disengaged from the second locating end 232. When the first locating end 231 is meshed with the second locating end 232, the hanging band 22 is under a retraction state. When the first locating end 231 is disengaged from the second locating end 232, the hanging band 22 can be hung securely.

The hanging band 22 can be retractably concealed into the front panel 11, or pulled outwards in a hanging state. The concealing state of the hanging band 22 can be limited by meshing of the first locating end 231 with the second locating end 232, whilst the hanging state of the hanging band 22 can be limited by abutting separately the first and second locating ends 231, 232 onto the first and second threading portions 211, 212. The locator 23 is either of the following members: male/female fastener, male/female adhesive tape and magnetic body. With this locator 23, the hanging band 22 can be limited in a hanging state, and positioned in a retraction state.

Based upon above-specified structures, the file holder of the present invention is mainly characterized by a hanging mechanism 20 additionally arranged onto the inner wall 14 of the front panel 11 of the main body 10. The hanging mechanism 20 is comprised of the limiting portion 21, hanging band 22 and locator 23, so that when the front panel 11 of the main body 10 is opened, the hanging mechanism 20 can be used for hanging purpose as detailed below.

Figure 4:
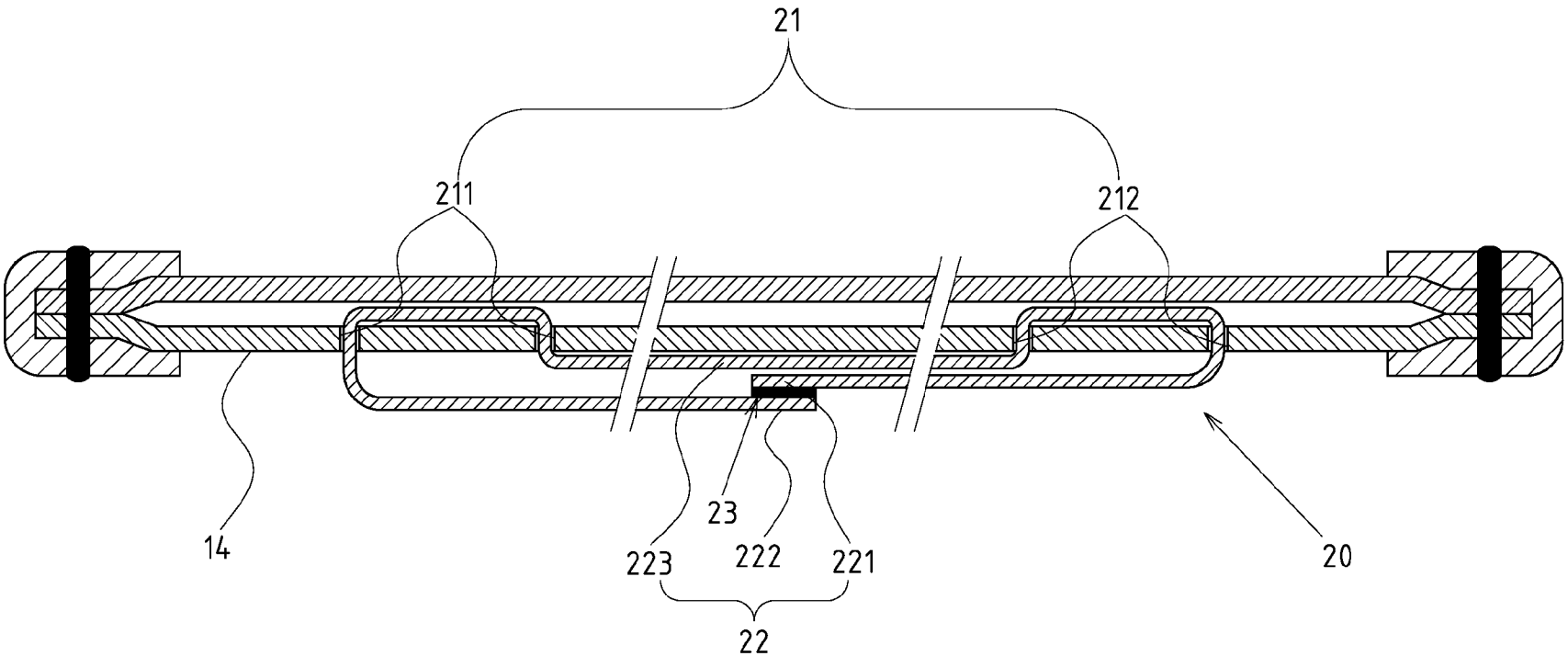
FIG. 4 shows a sectional view of the present invention, showing the hanging band positioned in a retraction state.
Figure 5:
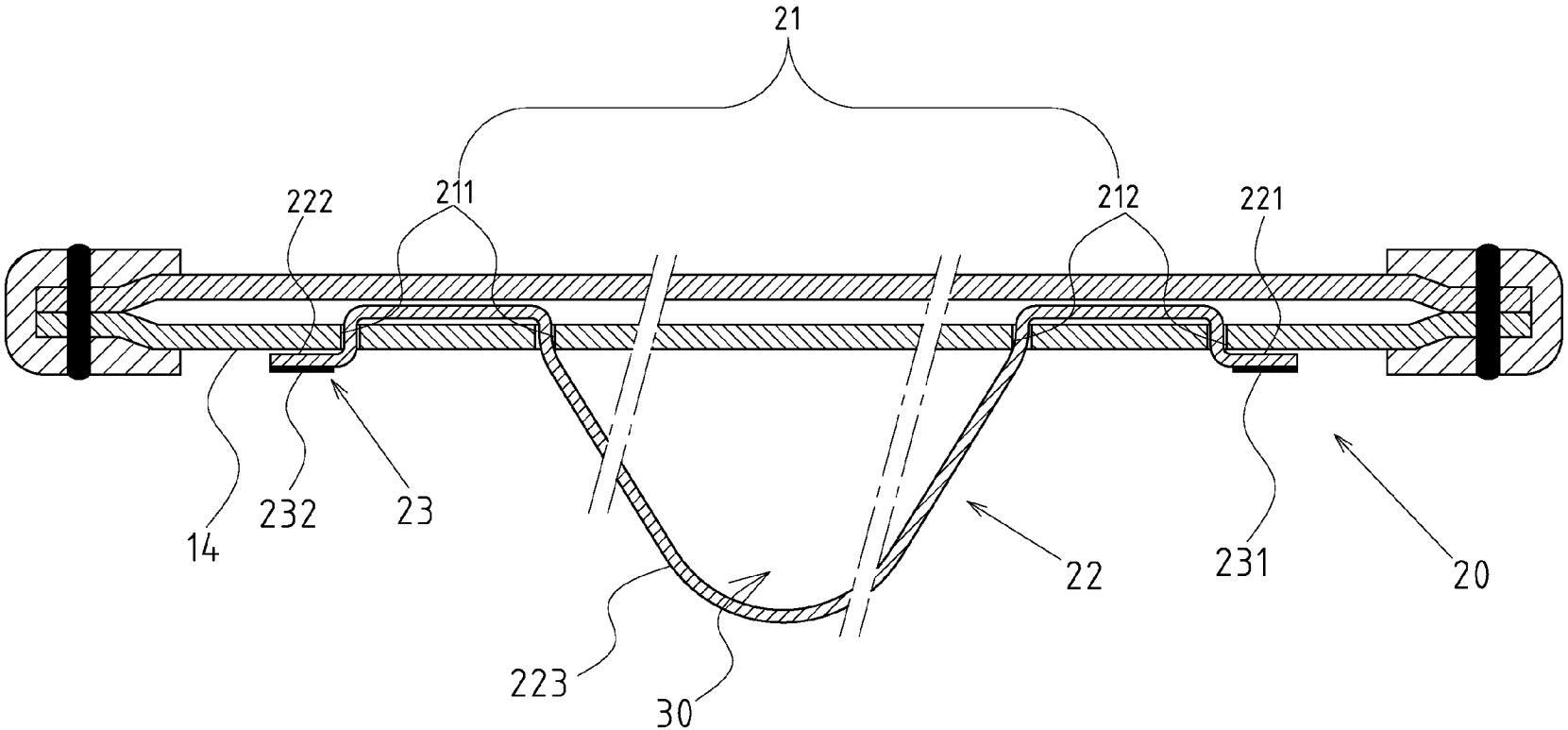
FIG. 5 shows a sectional view of the present invention, showing the hanging band pulled in a hanging state.

Referring to FIGS. 3 and 5, the intermediate section 223 of the hanging band 22 can be pulled, and the first and second locating ends 231, 232 at both ends 221, 222 of the hanging band 22 can be separately used for limitation at the first and second threading portions 211, 212. When the hanging band 22 is pulled in a limiting state, a hanging space 30 can be formed, enabling the users to access the files in the accommodation space 13. Conversely, when the hanging space 30 is to be removed, the first locating end 231 and second locating end 232 are pulled at two sides (shown by L1 in FIG. 3). Meanwhile the first locating end 231 and second locating end 232 of the locator 23 are mated together so that the hanging band 22 can be positioned in a retraction state (shown in FIGS. 2, 4). Moreover, the front panel 11 can be closed and covered onto the opening of the accommodation space 13 (in conjunction with FIG. 1), so that the hanging mechanism 20 can be concealed to realize an aesthetically pleasing main body 10. When it is intended to use the hanging mechanism 20, the first locating end 231 and second locating end 232 can be removed easily and quickly while pulling the hanging band 22 for the purpose of usage.

I claim:

1. A file holder, comprising:

a main body, being comprised of a front panel, a rear panel arranged at intervals, and an accommodation space between the front and rear panels, said front panel being provided with an inner wall;

a hanging mechanism being arranged onto the inner wall of the front panel of the main body and comprising:

a limiting portion, being set on the inner wall of the front panel and having a first and a second threading portion arranged at intervals;

a hanging band, being extended to form two ends and an intermediate section and penetrated onto the first and second threading portions of the limiting portion; and a locator, arranged at two ends of the hanging band and fitted with a first and a second locating ends, the first locating end meshed with or disengaged from the second locating end, the hanging band retractably concealed into the front panel, or pulled outwards in a hanging state, a concealing state of the hanging band limited by meshing of the first locating end with the second locating end, the hanging state of the hanging band limited by abutting separately the first and second locating ends onto the first and second threading portions.

2. The file holder defined in claim 1, wherein the first and second threading portions of the limiting portion are of two through-holes arranged at intervals.

3. The file holder defined in claim 1, wherein the locator is selected from a group consisting of: male/female fastener, male/female adhesive tape and magnetic body.

* * * * *